US005316490A

United States Patent [19]

Clemence et al.

[11] Patent Number: 5,316,490

[45] Date of Patent: May 31, 1994

[54] MODULAR ELEMENT FOR AN ELECTRICAL POWER DISTRIBUTION DUCT

[75] Inventors: Michel Clemence; Christian Barocci, both of Saint Marcellin; Christian Dupoux, Pont-En-Royans, all of France

[73] Assignee: Société en Nom Collectif: Normabarre, Saint Marcellin, France

[21] Appl. No.: 961,357

[22] Filed: Oct. 15, 1992

[30] Foreign Application Priority Data

Oct. 16, 1991 [FR] France ..... 9112752

[51] Int. Cl.[5] ..... H01R 13/44; H01R 25/00

[52] U.S. Cl. ..... 439/114; 439/113; 439/140; 439/207

[58] Field of Search ..... 439/110, 113, 114, 120, 439/207, 210, 140, 139

[56] References Cited

U.S. PATENT DOCUMENTS

| | | | |
|---|---|---|---|
| 2,720,632 | 10/1955 | Stieglitz | 439/114 |
| 3,044,036 | 7/1962 | Herrmann | 439/114 |
| 3,099,504 | 7/1963 | Rowe | 439/114 |
| 3,710,300 | 1/1973 | Koenig et al. | 439/114 |
| 4,082,393 | 4/1978 | Gamble | 439/110 |

FOREIGN PATENT DOCUMENTS

| | | | |
|---|---|---|---|
| 3434643 | 4/1986 | Fed. Rep. of Germany . | |
| 3812465 | 10/1989 | Fed. Rep. of Germany . | |
| 2493055 | 4/1982 | France . | |
| 2203299 | 10/1988 | United Kingdom | 439/113 |

*Primary Examiner*—Mark Rosenbaum
*Assistant Examiner*—David P. Bryant
*Attorney, Agent, or Firm*—Sughrue, Mion, Zinn, Macpeak & Seas

[57] ABSTRACT

A modular element for an electrical power distribution ducting has an elongated box section structure. Inside the box section structure conducting electrical power distribution bars are arranged. Lateral access can be gained to the bars through distribution openings in the box section structure. At least some of the openings are protected by a closing-off protective device in the absence of a tapping. The box section structure is composed of two beam members each having two longitudinal grooves into which the respective longitudinal edges of two pre-shaped strips having a U-shaped cross section engage elastically. The edges are fixedly retained inside the longitudinal grooves of the beam members. One of the beam members optionally carries bus bars for low current power distribution.

13 Claims, 2 Drawing Sheets

MODULAR ELEMENT FOR AN ELECTRICAL POWER DISTRIBUTION DUCT

BACKGROUND OF THE INVENTION

The invention relates to ducts for electrical power distribution.

It is well known to provide distribution of electrical power in industrial plant using ducting built up from prefabricated modular elements, which are usually located end-to-end as a function of requirements, for feeding power consuming equipment from a distribution panel connected to a source of power such as the public utility supply network.

It is also entirely conventional to provide for the distribution of relatively low power supplies, essentially concerning lighting to be separate from the distribution of what is commonly known as medium power and which concerns other items of electrical equipment having a fairly high power consumption, often involving high currents which can for example amount to something of the order of 100 to 500 Amperes. This leads to two separate power distribution circuits coexisting on the same premises, using separate ducting that follow at least partly the same route, with consequent disadvantages in the areas of cost, space taken up and actual running.

SUMMARY OF THE INVENTION

The invention hence provides a modular element for electrical power distribution ducting comprising an elongated box section structure. Inside the bar, conducting electrical power distribution bars are arranged to which lateral access can be gained through distribution openings in said box section structure. At least some of said openings are protected by a closing-off protective device in the absence of a tapping thereinto. The element is designed for simplifying and facilitating the installation and running of the distribution circuits in a plant.

According to one feature of the invention, the box section structure of a modular element includes two beam members each having two longitudinal grooves into which the respective longitudinal edges of two pre-shaped strips having a U-shaped cross section engage elastically. They thereby become fixedly retained inside the longitudinal grooves of the beam members. The pre-shaped strips together with the beam members define therebetween a longitudinal cavity in which medium power electrical power distribution bars are housed.

The invention, its features and advantages will now be described in detail with reference to the attached drawings described below.

DETAILED DESCRIPTION OF PREFERRED EMBODIMENT

Figure 1:
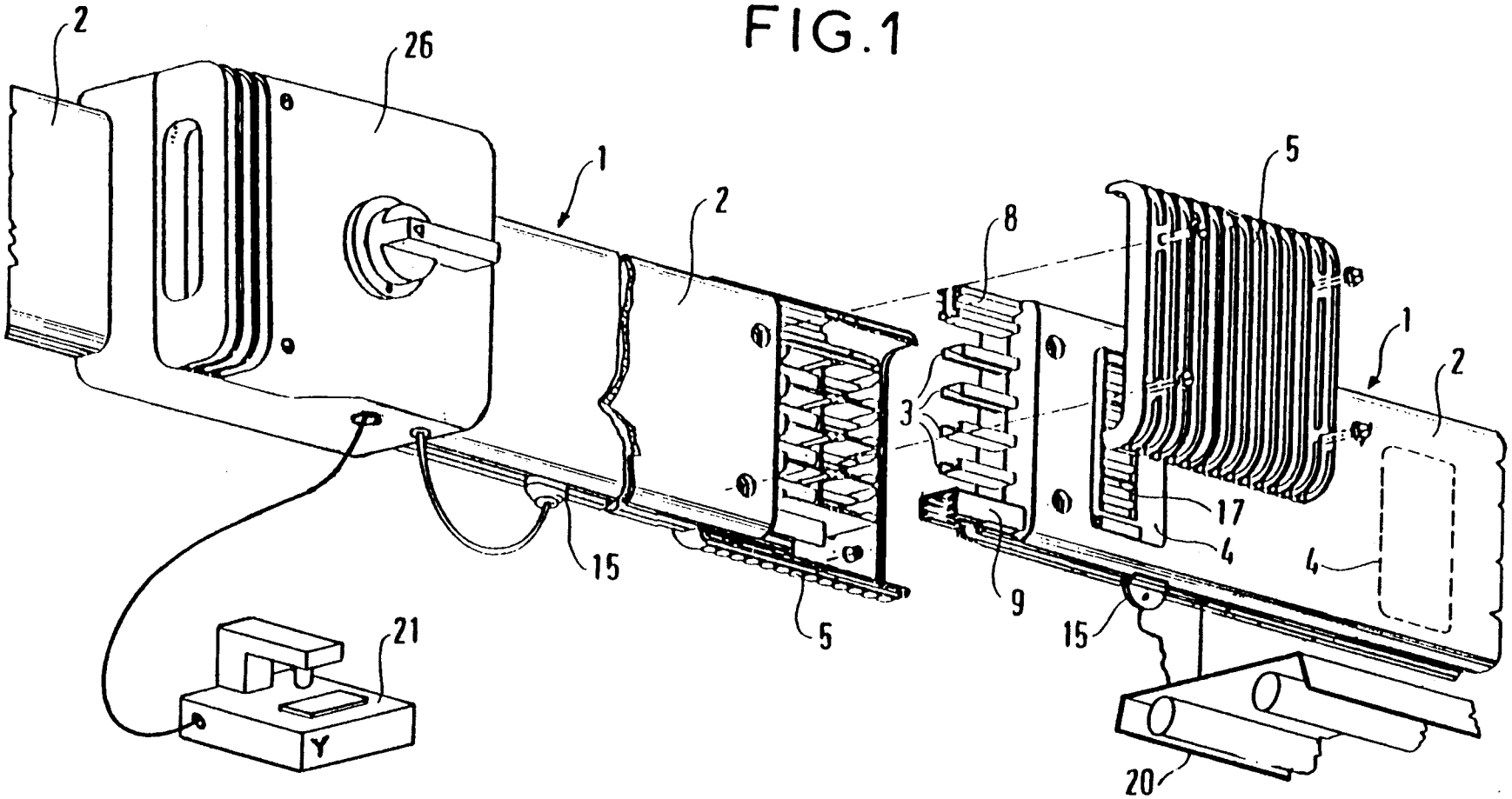
FIG. 1 is a partially exploded perspective view of a part of a ducting system consisting of modular elements in accordance with the invention.

The part of the electrical power distribution ducting system shown in FIG. 1 as illustrated consists of two modular elements 1 designed to be connected end-to-end.

Each modular element comprises an elongated box section structure in which medium power electrical distribution bars 3 are arranged longitudinally, comprising for example three phase bars and one neutral bar. A grounding conductor is associated with these bars and, for example, consists of a conducting beam, such as beams bearing reference numerals 8 or 9, of said box section structure. Access can be gained to the bars 3, firstly at their ends via at least one outer end of the box section structure which contains them, and, secondly, via lateral distribution openings 4 formed in, for example, alternating fashion on the two opposing sides of the box section structure 2, and along the box section structure if necessary.

Connecting parts known per se, and which are not illustrated, enable electrical continuity to be set up between corresponding bars 3 of two modular elements 1 located end-to-end. In the embodiment shown, these connecting parts are enclosed in a shroud consisting of two mating half-shells 5 which, here, are identical and are fitted over the assembled together end portions of two box sections 2 located end-to-end, and are introduced from opposing sides of the assembly thus formed in order to constitute a protective sleeve.

One of these shrouds for example provides support for the electrical connecting parts mentioned above.

Figure 2:
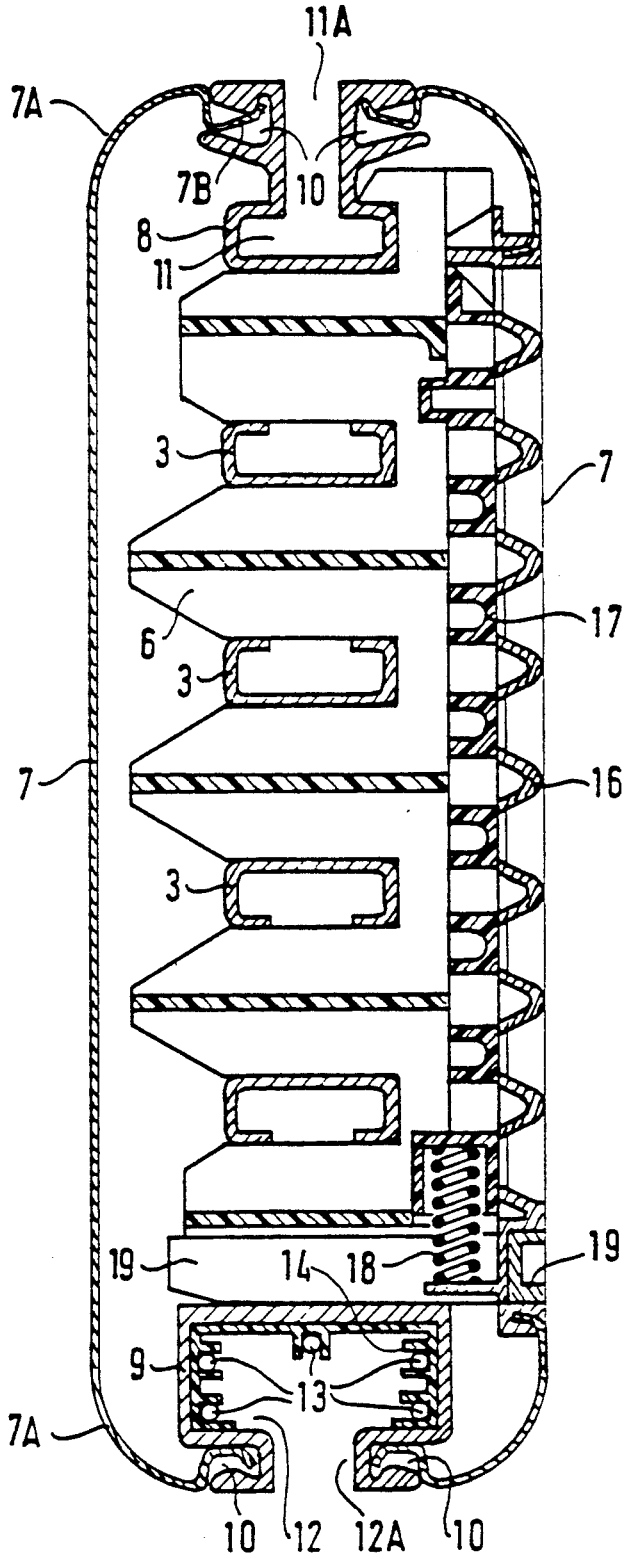
FIG. 2 is a cross-section of a modular element of a duct according to the invention, the section being taken at a power take-off point.

The bars 3 are conventionally held in place in their box section structure by mounting blocks 6, for example of the insulation comb type, such a mounting block which, here, is common to the various bars 3 and is, for example, of a one-piece construction, being shown in FIG. 2.

According to the invention, the box section structure of a modular element is formed using strips of pre-shaped metal sheet 7 which are fastened longitudinally onto rigidifying beams indicated by reference numerals 8 and 9 in the figures. In the embodiment shown, a modular element comprises two pre-shaped strips 7 which are identical and both have a U-shaped cross-section thereby defining a housing for carrying conducting bars 3 when the half-shells are united in an appropriate manner with only their longitudinal sides brought together.

In the example shown, each pre-shaped strip 7 comprises a long flat middle region laterally bordered by two regions which are arched symmetrically with respect to a longitudinal plane of symmetry of the strip, in order to provide said strip with a determined transverse flexibility.

In a manner known in this field, the required flexibility can also be obtained with a roughly equivalent symmetrical structure which uses matching inclined flat faces or, yet again, through the use of a strip which only includes one single arched region or one inclined flat face along one side only of the flat longitudinal region the other side of which then can be fitted onto one of the beams 8 or 9.

In the embodiment shown, the lateral distribution openings 4, of, for example, rectangular shape, are here provided in the central flat region of the strips. Each one of the beams 8 and 9 carries a longitudinal groove 10 on two opposing sides thereof, this groove being shaped to receive, and to retain, a longitudinal edge of the pre-shaped strip 7 which is inserted thereinto during assembly of the box section structure 2 of which it constitutes a part.

Each longitudinal side of the pre-shaped strip has been shaped by bending or rolling so as to resiliently fit into the longitudinal retaining groove into which it is inserted, the latter having a shape that mates therewith in order to ensure said retention, using techniques well known in this field which will not be detailed here.

In a preferred embodiment, the beam member 8 is designed to act as a mounting member for the box section structure of modular element 1 which carries it, and preferably consists of a symmetrically shaped part carrying a longitudinal T-shaped channel 11 bordered laterally on both sides by the longitudinal grooves 10 for retaining the pre-shaped strip 7.

A central longitudinal slot IIA for gaining access to longitudinal channel 11 of the beam member 8 is designed so as to be open, at an outer border of the box section structure, between the curved regions of the two pre-shaped strips 7 which are each fixed to one side of the beam member thus allowing the modular element that it carries to be engaged onto a support member, notably a suspension hook which is not shown, which for example, has itself a T-shape which is engaged into longitudinal channel 11, its shape being designed to match that of said channel.

Beam member 8 consists for example of an elongate shaped member made of aluminum, enabling it to be used as a ground conductor. Beam 9 is preferably also constituted by a shaped aluminum member carrying longitudinal grooves 10 allowing the pre-shaped strip to be fixed at both of its sides. This beam member 9 includes a central longitudinal cavity 12 having an open slot 12A and which is oriented in a direction parallel to that of grooves 10 and which is open at an outer border of the box section structure between the curved regions of the two pre-shaped strips 7 of the box section structure and at the opposite end to the longitudinal channel 11 of beam member 8.

Longitudinal duct 12 is fitted out internally with longitudinal conducting bus bars 13 of a type notably designed for relatively low electric power distribution such as that used for lighting, carrying, for example, currents of the order of 20 to 40 Amperes, or, alternatively, of the type used for remote control enabling remote electrical units to be started up or reset, or for monitoring electrical receivers.

In accordance with a conventional arrangement in the lighting duct field, the bars 13 are fixed internally of the said cavity by gripping them inside fastening elements, such as indicated by reference numeral 14, made of an insulating material. In accordance with a type of design which is well known, these latter leave the major portion of conducting bus bars 13 bare to allow a tapping to be made thereonto at practically any desired point along the modular element. Such a tapping is for example set up via a specially designed power take-off plug, known per se, such as 15—see FIG. 1—which partially fits into duct 12 through slot 12A in order to bear against the conducting bus bars 13 via contact elements which are not shown as they are perfectly conventional in this field.

This enables electrical equipment, such as lighting unit 20, to be connected to a medium-power distribution circuit, this being done at differing levels, certain ones of the items of equipment being able to be optionally fixed directly onto the modular element that powers them. This also enables an item of electrical equipment 21 to be remote-controlled via an electrical unit, which is not shown, which is housed in a distribution box 26 and linked to the bars by a connector 15.

As has been indicated above a modular element 1 may include one or several lateral distribution openings 4 which, as they each carry a closing device, include a movable shutter arrangement which requires to be moved from its normal position in order to establish a tapping connection. Each device includes, for example, and in accordance with a conventional type of design, a closing flap 16 which is fixed and provided with parallel slots and an internal shutter 17 in an insulating material provided with parallel slots corresponding to the slots in the flap down which said shutter is designed to slide. Should a tapping not be made, the shutter is elastically urged, by means of, for example, a spring 18 so that the slots in shutter 17 are not opposite those in flap 16 and the flap-shutter combination insulates the medium power distribution conducting bars 3 from any contact with the outside via the lateral distribution opening 4 which includes the relevant flap and shutter combination. Causing the slots of shutter 17 and flap 16 of an opening 4 to, on the other hand, line up allows parallel contacts of a flat design and carried by a suitable known power take-off connector to be introduced into the longitudinal cavity through these slots and against the corresponding conducting bars 3 and protection beam member 8.

Lastly, in a preferred embodiment of the modular elements, beam member 9 of a box section construction tends to be elastically urged towards beam member 8 of the box construction by the pre-shaped strips 7 by virtue of the relative elasticity of the sheet metal constituting them and their respective curvatures. In this embodiment, the fixing blocks 6 for the conducting bars 3 housed in a box section structure are held fixedly in abutment against beam member 8, by beam member 9 under the recall spring action of the pre-shaped strips 7 which are mechanically tensioned by a system of wedge-shaped packing pieces. For this, an entry hole for a mechanical tensioning packing piece 19 is provided at each of the lateral distribution openings 4 and, here, via the flap 16 used for closing off this opening. Each hole for entry of a wedge-shaped packing piece is here provided at the region comprised between beam member 9 and an adjacent part of a block 6 used for fixing the bars, so as to allow the relevant beam member to be spaced with respect to said fixing block after a suitably dimensioned packing piece 19 has been inserted under force between them, the result of which is to lead to the desired transverse tensioning being applied to the pre-shaped strips 7 of the relevant box section structure, together with simultaneous immobilization of the beam members 8 and 9 with respect to each other under force.

The outer portion of a wedge-shaped packing piece 19 is preferably designed to act as a locating key system for every distribution box that is connected up at the distribution opening where it is fitted. This is particularly provided in order to prevent boxes other than those designed to be connected up to the relevant ducting from being fitted when said ducting carries one or several specialised links, for example supplying specific voltages or designed to serve specific items of equipment in an installation. For this purpose, a locating key system, of the male-female type for example, allows a box that is compatible to be connected up whereas one that is not compatible cannot be connected up.

What is claimed is:

1. A modular element for electrical power distribution ducting comprising: an elongated box section structure, conducting electrical power distribution bars arranged inside said box section, distribution openings in said box section structure for lateral access to said distribution bars, a closing-off protective device closing off at least one of said openings in the absence of a tapping therein, said box section structure being composed of two beam members, each beam member having two longitudinal grooves, respective longitudinal edges of two pre-shaped strips having a U-shaped cross section engaged elastically into said longitudinal grooves to thereby become fixedly retained inside said longitudinal grooves of said beam members, said pre-shaped strips together with said beam members defining therebetween a longitudinal cavity, medium power electrical power distribution bars being housed inside said longitudinal cavity, and at least one of said beam members forming a grounding conductor for said ducting.

2. A modular element for electrical power distribution ducting according to claim 1, wherein each of the two pre-shaped strips of a box section structure consists identically of a first long flat central region bordered by two second regions that are symmetrically arched with respect to a longitudinal plane of symmetry of said strip in order to impart a determined transverse elasticity thereto with each strip carrying a shaped edge for enabling said strips to be fixed into a matching longitudinal groove of said beams.

3. A modular element for electrical power distribution ducting according to claim 2 in which said medium power electrical power distribution bars are rendered immobile by means of at least one fixing block, and wherein said ducting includes at least one wedge-shaped packing piece inserted under force between a beam member and an end portion of said at least one fixing block against the other beam member by another end portion thereof.

4. A modular element for electrical power distribution ducting according to claim 3, further including passages introducing said wedge-shaped packing pieces between one of said beams and at least one of said fixing blocks for said conducting bars, said passages each being formed at one of said lateral distribution openings providing in a first flat median region of said pre-shaped strip.

5. A modular element for electrical power distribution ducting according to claim 4, wherein one of said passages for introducing said wedge-shaped packing piece and provided at one of said lateral distribution openings is formed in a closing flap for said opening.

6. A modular element for electrical power distribution ducting according to claim 4, further including at least one wedge-shaped packing piece fitted with a locating key for a power distribution outlet box fitted at one of said lateral power distribution openings.

7. A modular element for electrical power distribution ducting according to claim 2, wherein one of said beam members includes a longitudinal T-shaped mounting channel having an external opening on said box section structure between said pre-shaped strips, and which is bordered on both sides thereof by said two longitudinal grooves fixing said pre-shaped strip.

8. A modular element for electrical power distribution ducting according to claim 1 in which said medium power electrical power distribution bars are rendered immobile by means of at least one fixing block, and wherein said ducting includes at least one wedge-shaped packing piece inserted under force between a beam member and an end portion of said at least one fixing block fixed against the other beam member by another end portion thereof.

9. A modular element for electrical power distribution ducting according to claim 8, further including passages introducing said wedge-shaped packing pieces between one of said beams and at least one of said fixing blocks for said conducting bars, said passages each being formed at one of said lateral distribution openings provided in a first flat median region of said pre-shaped strip.

10. A modular element for electrical power distribution ducting according to claim 9, wherein one of said passages introducing said wedge-shaped packing piece and provided at one of said lateral distribution openings is formed in a closing flap for said opening.

11. A modular element for electrical power distribution ducting according to claim 9, further including at least one wedge-shaped packing piece fitted with a locating key for a power distribution outlet box fitted at one of said lateral power distribution openings.

12. A modular element for electrical power distribution ducting according to claim 1, wherein one of the two beam members includes a longitudinal channel forming a distribution duct for lighting and/or remote control purposes, and being fitted out internally with bared bus bars that are accessible for electrical connection or tapping via an externally open longitudinal slot extending along said one beam member at an outer border of said box section structure between said pre-shaped strips.

13. A modular element for electrical power distribution ducting according to claim 1, wherein one of said beam members includes a longitudinal T-shaped mounting channel having an external opening on said box section structure between said pre-shaped strips, and which is bordered on both sides thereof by said two longitudinal grooves fixing said pre-shaped strip.

* * * * *